US006056125A

United States Patent [19]

Lai et al.

[11] Patent Number: 6,056,125

[45] Date of Patent: May 2, 2000

[54] CROSS FLOW CYCLONIC FLOTATION COLUMN FOR COAL AND MINERALS BENEFICIATION

[75] Inventors: Ralph W. Lai, Upper St. Clair; Robert A. Patton, Pittsburgh, both of Pa.

[73] Assignee: U. S. Department of Energy, Washington, D.C.

[21] Appl. No.: 08/889,588

[22] Filed: Jul. 8, 1997

[51] Int. Cl.[7] ..... B03D 1/24; B03D 1/14

[52] U.S. Cl. ..... 209/164; 209/168; 209/169; 209/170

[58] Field of Search ..... 209/164, 168, 209/169, 170

[56] References Cited

U.S. PATENT DOCUMENTS

| | | |
|---|---|---|
| 3,339,730 | 9/1967 | Boutin . |
| 4,592,834 | 6/1986 | Yang . |
| 4,744,890 | 5/1988 | Miller et al. . |
| 4,750,994 | 6/1988 | Schneider . |
| 4,964,576 | 10/1990 | Datta . |
| 5,116,487 | 5/1992 | Parekh . |
| 5,224,604 | 7/1993 | Duczmal et al. . |

FOREIGN PATENT DOCUMENTS

| | | |
|---|---|---|
| 829305 | 3/1998 | European Pat. Off. . |
| 57-50562 | 3/1982 | Japan . |
| 58-143860 | 8/1983 | Japan . |

OTHER PUBLICATIONS

"Preliminary Results from a Cross Flow Flotation Column for Enhanced Pyritic Sulfus Rejection from Coal," Ralph W. Lai and Robert A. Patton.

*Primary Examiner*—Thomas M. Lithgow
*Attorney, Agent, or Firm*—Mark F. LaMarre; Mark P. Dvorscak; William R. Moser

[57] ABSTRACT

An apparatus and process for the separation of coal from pyritic impurities using a modified froth flotation system. The froth flotation column incorporates a helical track about the inner wall of the column in a region intermediate between the top and base of the column. A standard impeller located about the central axis of the column is used to generate a centrifugal force thereby increasing the separation efficiency of coal from the pyritic particles and hydrophillic tailings.

16 Claims, 6 Drawing Sheets

FLOWSHEET OF COLUMN FLOATATION CIRCUIT

FROM LINE 4-4

BTU RECOVERY VS. % SULFUR REJECTION

CROSS FLOW CYCLONIC FLOTATION COLUMN FOR COAL AND MINERALS BENEFICIATION

STATEMENT REGARDING FEDERALLY SPONSORED RESEARCH OR DEVELOPMENT

The United States Government has rights in this invention pursuant to the employer-employee relationship of the U.S. Department of Energy and the inventor.

BACKGROUND OF THE INVENTION

1. Field of the Invention

This invention relates to mineral beneficiation by the separation of a preferred component from a mixture by froth flotation. More particularly, this invention relates to an improved method and apparatus for the separation of finely ground minerals and contaminants by combining froth flotation separation with density separation techniques.

2. Description of Related Art

Flotation, in particular froth flotation, is one of the primary solid-solid separation processes for fine particles. The process has been widely practiced for almost a century in the mining industry for concentrating valuable minerals such as phosphate rock, precious metals, lead, zinc, copper, molybdenum, and tin containing ores as well as coal. Typically, the froth flotation process has been developed to work in water, with air as the froth generating gas, however, other liquid and gas combinations can be used With the froth flotation process one or more specific particulate constituents of a slurry or suspension of finely dispersed particles become attached to gas bubbles so that they can be separated from the other constituents of the slurry or suspension. The froth flotation process exploits the wettability differences of the particles to be separated. Differences in the wettability among solid minerals particles can be natural, or can be induced by the use of chemical additives. The buoyancy of the bubble/particle aggregate, formed by the adhesion of the gas bubble to a particle in the slurry, is such that it rises to the surface of the flotation vessel where it is separated from the remaining particulate constituents which remain suspended in the aqueous phase of the suspension.

The particles to be separated by the froth flotation process are in the size range of about 500 $\mu$m to 2-10 $\mu$m; however, 65 mesh (230 $\mu$m ) to 270 mesh (53 $\mu$m) is typical. Raw ore is comminuted in size from boulders of up to 100 cm in diameter to a size range of from about 3 cm to about 0.5 cm using jaw crushers, cone crushers, gyratory crushers, or roll-type equipment. If ore of this size is to be used in a subsequent process, the sized ore is sieved and/or washed to remove impurities that concentrate in the fine particle size range. When the entire volume of ore is to be processed by froth flotation further size reduction using rod mills and ball mills is used to bring the particle size of all the ore to finer than about 65 mesh (230 $\mu$m). The primary objective of this is to generate mineral grains that are discrete and distinct from one another. The generation of distinct particles is essential for the exploitation of individual mineral properties in the separation process. At the same time, particles at such fine sizes can be more readily buoyed to the top of the flotation cell by gas bubbles that adhere to them.

The flotation step is accomplished by the preparation of pulp, consisting of a solid-liquid slurry that may contain up to 40% solids, to which chemical reagents known as collectors are added in a conditioning tank. Selected reagents are added to render some minerals hydrophobic so that they selectively adhere to air bubbles introduced into the pulp in a flotation cell. On the other hand, some reagents are added to enhance selectivity through activation and depression phenomena. Frothers are also used to generate a mineral-laden froth layer and enhance particle-bubble adhesion. The products from the flotation cell are a concentrate and a tailing stream. The concentrate proceeds to the next step for further cleaning or treatment. A typical froth floatation process can treat, for example, a raw feed that assays 0.5% to a few percent copper to give a mineral concentrate analyzing 35% copper with a recovery of more than 85% of the copper content of the original ore.

The actual flotation process occurs in flotation cells usually arranged in batteries in an industrial plant. The individual cells can be any size from a few to 30 $m^3$ in volume. Also, column cells have become popular, particularly in the separation of very fine particles in the minerals industry and colloidal precipitates in environmental applications. Such cells can vary from 3 to 9 meters in height and have a cross section of 0.3 to 1.5 meters in width.

Traditionally, in the U.S., only about 5 percent of fine coal is cleaned by froth flotation because of technical difficulties and unfavorable economics. Fine coal processing by froth flotation is associated with difficulties in froth handling, product dewatering, low throughput, and inefficient separation of impurities such as pyrites. Therefore, traditionally, a majority of the coal in the U.S. is cleaned at coarse and intermediate sizes (down to 28 mesh) by gravity separation. A significant portion of the coal fines (minus 28 mesh or less than 0.595 mm.—equivalent to 0.0234 inches) are discarded as waste into tailings ponds. Therefore, it is believed, there is a need to augment the froth flotation process and the flotation column in particular with an efficient secondary separation process based on density separation in order to improve the utilization of fine coal.

It has been noted in the art that the froth flotation process does not always provide complete separation of desired materials from unwanted impurities. A number of modifications have been suggested to the froth flotation process to improve the efficiency of the separation.

A method and apparatus for separating coal or mineral ore fines by froth flotation are disclosed by Miller et al., U.S. Pat. No. 4,744,890. Miller discloses a countercurrent flotation device and method that use a vertically oriented, cylindrical flotation vessel having a tangential inlet at its upper end and an annular outlet at its lower end. A pedestal positioned within the lower end of the vessel serves to support the froth column formed within the flotation cell and to minimize mixing between the froth column and the fluid discharge. The configuration of the flotation vessel, with its tangential inlet and annular outlet directs the particulate suspension around the vessel in a swirling motion. The froth column, which carries one component stream, exits through the top, center of the column, while the second component exits around the outer perimeter at the bottom of the column. This design has the disadvantage that the fluid flow and the centrifugal forces are coincident, making it difficult to separate the effects of froth flotation from the secondary separation method. Further, this system utilizes a porous column wall to introduce gas into the flotation process which acts counter to density separation by the use of centrifugal force.

An alternate method and apparatus for separating coal or mineral ore fines by a swirl-flow pattern to develop centrifugal forces on the liquid or gas stream are disclosed by Duczmal et al., U.S. Pat. No. 5,224,604. Duczmal discloses an air-sparged hydrocyclone flotation device and method for the separation of particles in either liquid or gas streams. The fluid stream is directed in a swirl-flow pattern in a porous-walled cylinder to develop centrifugal forces on the stream. Magnetic or electrical fields can be applied to the system to enhance separation of the particles. Air sparging may also be employed to further amplify the separation of hydrophilic particles from hydrophobic particles in a liquid system. The swirl-flow pattern exits the downstream end of the separator where a stream splitter is employed to split the swirl-flow pattern stream which splays outwardly at the outlet in two or more streams which carry desired particles to be recovered. The hydrocyclone of Duczmal has the disadvantage that the fluid flow and the centrifugal forces are coincident making it difficult in separating the effects of froth flotation from the secondary separation technique/method. Further, the hydrocyclone of Duczmal provides minimal mixing of the materials to be separated. Also, in one embodiment, both impurities and desired products enter from the same end and are discharged at different radii from the other end.

BRIEF SUMMARY OF THE INVENTION

An object of this invention is to provide an improved froth flotation apparatus and process having increased separation efficiency.

Another object of this invention is to provide an improved froth flotation device that augments the froth flotation process for the separation of fine particle minerals by adding density separation.

Another object of this invention is to provide an improved froth flotation process that removes higher density hydrophilic material by means in addition to froth flotation.

Another object of this invention is to separate coal from clay and pyrite (and other heavy metals and minerals) by taking advantage of the large difference in their specific gravities, whereas the specific gravity of coal is 1.2, while the specific gravity of pyrite is 5.0.

These and other objectives of the invention, which will become apparent from the following description, have been achieved by a novel froth flotation column for the separation of at least two different materials, comprising a cylindrical column having at least one helical track adjacent to the inner surface of the column and located intermediate between the top and the bottom of the column. The helical track is a piece of linear material that is attached to the inside of the column. The helical track is attached to the column in a spiral fashion with the respective ends marking imaginary planes intersecting the column and defining a separation zone. The pitch (angle of the incline of the spiral) of the helical track is inclined from 10° to 60° from the horizontal, and preferably from 25° to 45° from the horizontal. The upper surface of the helical track can be horizontal or it can be inclined so that it slopes toward the inside of the column wall. This inclination is at an angle of from about 20° to about 60° from the horizontal and preferably at an angle of from about 40° to about 60° from the horizontal.

A central mixing shaft is located along the axis of the column. The mixing shaft is attached to a motor to provide for variable speed rotation. The other end of the shaft terminates within the column. At least one impeller is attached to the shaft and at least an impeller is located within the separation zone of the column. The rotation of the mixing shaft can be in the same direction as the pitch of the helical track or it can be in the opposite direction. For example, when viewed from above, if the helical track spirals down in a clockwise direction the mixing shaft can be made to rotate in either the clockwise or counter clockwise direction. It is preferable to have the pitch of the helical path and the rotation of the mixing shaft in opposite directions. The impeller and shaft provide for agitation of the mixture within the froth flotation column. A gas inlet or air sparger is located near the bottom of the column. The air sparger should be spaced at a sufficient distance from the bottom to allow hydrophilic tailings and high density particles to exit through the discharge port at the bottom of the column. The gas inlet permits the introduction of a stream of fine gas bubbles into the column for the separation of at least one of the component from the feed material.

A feed material comprising a slurry of the material to be separated, chemical additives, and a liquid solvent are mixed in a separate tank or sump and is conveyed to the column through appropriate piping and pumping equipment. The slurry is then introduced into the column. The slurry of feed material can be introduced at the top of the column or at any point intermediate between the top and bottom of the column. The feed material is introduced through an opening that is provided for the slurry to be introduced perpendicular to or tangentially to the column wall. A first discharge port is provided near the top of the column for removing at least one component to be separated. A second discharge port is located near the bottom of the column for removing at least one of the other components to be separated.

A concentrate holding tank is attached to the first discharge port to provide for further cleaning and drying of the hydrophobic material removed from the top of the column. A tailing holding tank attached to the second discharge port for further processing of the higher density material and hydrophilic material from the bottom of the column.

The apparatus and process of this invention can be used to separate a two component mix. However, it is preferable to use at least a three-component mix comprising a material that will be made hydrophobic through the use of additives, a hydrophilic material, and a higher density material, to take advantage of this invention.

BRIEF DESCRIPTION OF THE SEVERAL VIEWS OF DRAWINGS

With this description of the invention, a detailed description follows with reference being made to the accompanying figures of drawings which form part of the specification, in which like parts are designated by the same reference numbers, and of which:

The invention is not limited in its application to the details and construction and arrangement of parts illustrated in the accompanying drawings since the invention is capable of other embodiments that are being practiced or carried out in various ways. Also, the phraseology and terminology employed herein are for the purpose of description and not of limitation.

DETAILED DESCRIPTION OF THE INVENTION

Figure 4:
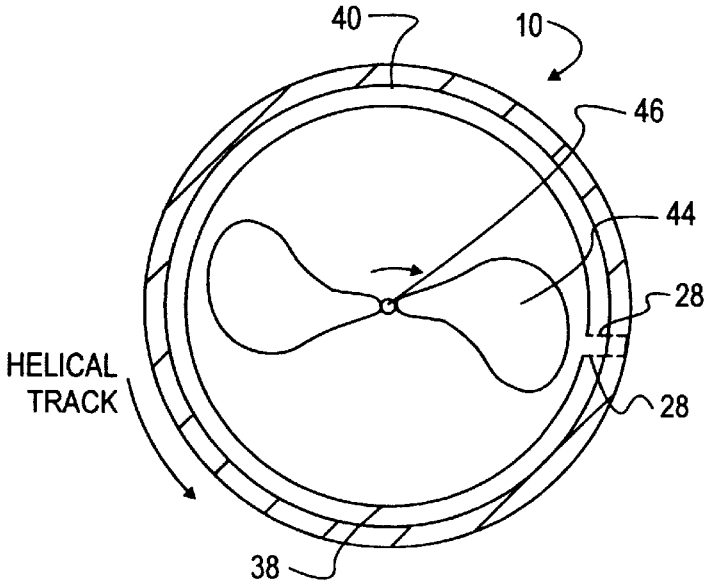
FIG. 4 is a top plan view taken along line 4—4 of FIG. 1 providing an axial view of the flotation cell.

Description of the Preferred Embodiment(s) Referring to FIG. 1, a flow sheet showing the froth flotation system using the cross-flow flotation cell (hereinafter referred to as "CFC") 10 of this invention is presented. The feed material 12 to be separated is introduced into sump 14 along with the appropriate reagents 16 and a suspension liquid 18, which is typically water. Typically, the feed material 12 to be separated by this system comprises a three-component mixture; hydrophobic particles or particles made hydrophobic after treatment with the appropriate chemical reagents, hydrophilic particles or particles made hydrophilic after treatment, and a high density particle. The resulting feed slurry 20 is fed through sump line 22 via pump 24 into feed line 26. The feed slurry 20 is injected into the CFC 10 via an opening 28 located at a place intermediate between the top 30 and bottom 32 of the CFC 10. The feed slurry 20 enters the separation zone 34 of the CFC 10. The feed slurry 20 can be injected tangentially or perpendicular to the wall 36 of the CFC 10, as illustrated in FIG. 4.

Figure 2:
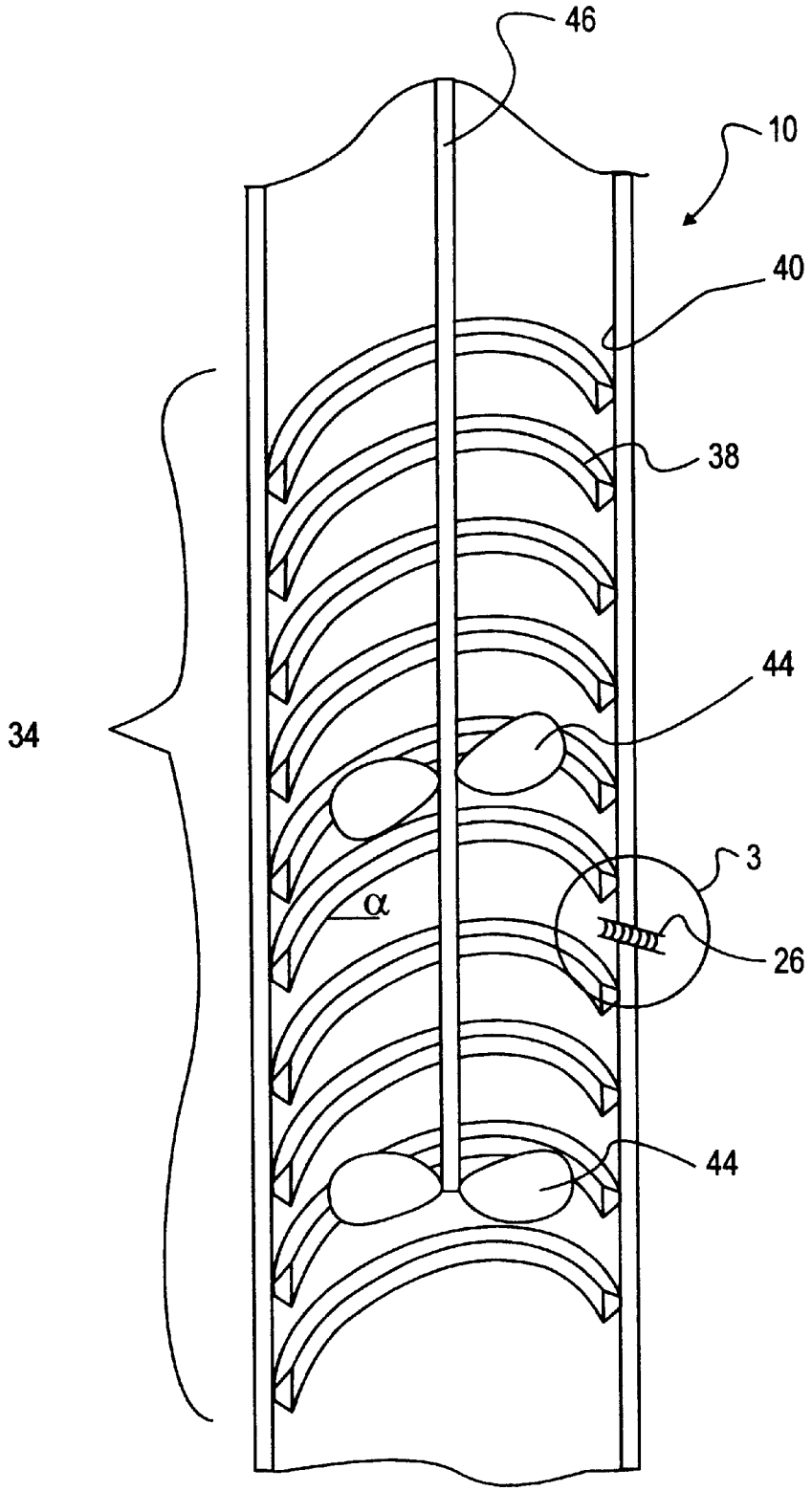
FIG. 2 is a partial cross-sectional view illustrating the flotation cell of this invention.
Figure 3:
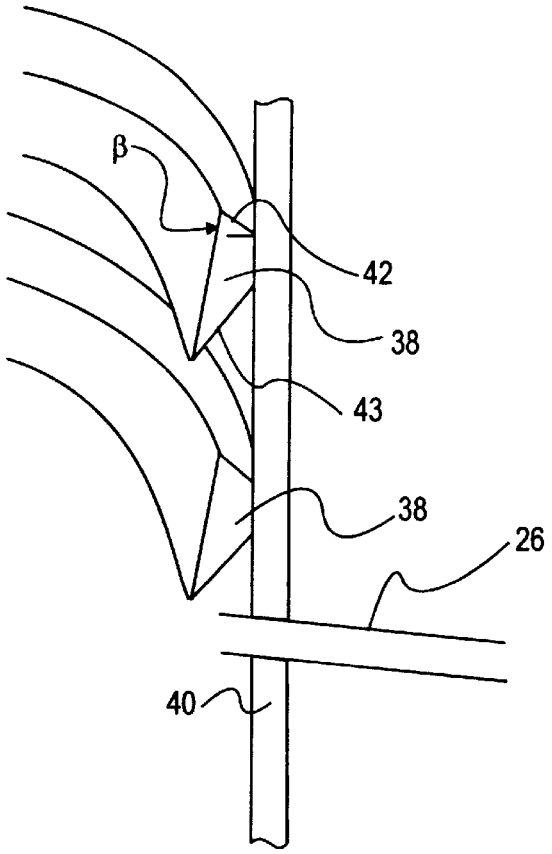
FIG. 3 is an enlarged view of area 3 of FIG. 2 illustrating the helical track for use with the flotation cell for use with this invention.

Referring to FIG. 2, a detailed discussion of the CFC 10 follows. A helical track 38 is placed around the inside wall 40 of the CFC 10. The helical track 38 can extend from the top 30 to the bottom 32 of the CFC 10 or from any two points intermediate between the top 30 and the bottom 32 of the CFC 10. The length of the CFC 10 in which the helical track 38 is located is referred to as the separation zone 34. The helical track 38 is a narrow strip of material attached to the inside wall 40. The helical track 38 is inclined or has a pitch (shown by ) at an angle of from about 10° to about 60°. Preferably the incline is from about 25° to about 45°. Preferably, the helical track 38 is inclined at an angle of 30°. Individual turns of the helical track 38 are spaced from each other by one to three times the width (the distance from the upper to the bottom surface of the track) of the material from which the helical track 38 is fabricated. The helical track 38 is from about 0.5 inches to 3 inches in thickness (the distance the track extends from the inside wall 40). In terms of dimensions relative to the CFC 10 diameter, preferably the thickness of the helical track 38 is from about 0.05 to about 0.20 times the diameter of the CFC 10. For example, when the CFC 10 has a diameter of 4 inches, the helical track 38 has a thickness of 0.375 inches. The upper surface 42 of the helical track 38 can be horizontal. Preferably the upper surface 42 is inclined at an angle β (as shown in FIG. 3) of from 20° to about 60°, and more preferably from about 40° to about 60°, in order to form an incline toward the inside wall 40 of the CFC 10. This stops material that falls on the track from easily returning to the separation zone 34 of the CFC 10. The bottom surface 43 of the helical track 38 can be inclined in a like manner to the upper surface 42 to simplify fabrication of the CFC 10, however, this is not required.

The feed slurry 20 entering the separation zone 34 is agitated by at least one impeller 44 attached to a central shaft 46. Rotation of the central shaft 46 is provided by motor 48. Air or gas bubbles are introduced into the CFC 10 by air spargers 50 located adjacent to the bottom 32 of the CFC 10. Air or gas is fed from source 52 through air line 54. The air sparger 50 for use with this invention can be any standard air spargers or air sparger systems known in the art, such as porous metal, porous glass or porous ceramic. A porous column wall should not be used to provide gas bubbles for flotation as this inhibits the efficiency of density separation through the use of centrifugal forces to drive the high density material to the column wall.

During flotation, the feed slurry 20 in the CFC 10 is mixed with by a series of impellers 44 attached to a central shaft 46. The pitch of the impellers is from about 25° to about 60°, and preferably about 45°. The diameter of the impeller 44 should be from one-quarter to one-half of the diameter of the CFC 10. The central shaft 46 is rotated at suitable rpm to generated sufficient centrifugal force on the high density particles to force them against the inside wall 40 of the CFC 10. A suitable angular velocity is from about 600 rpm to about 3600 rpm. Preferably, a suitable angular velocity is from about 1000 rpm to about 300 rpm. For example, a high density particle having a specific gravity of 5.0 and a CFC 10 having an interior diameter of 4 inches, an angular velocity of from about 600 to about 2000 rpm produces suitable results. This angular velocity helps to create a string of vortices near the central shaft 46 during the mixing. The slurry is moved in a circular motion by stirring in a counterclockwise direction and is moving slightly upward, while the helical track 38 is arranged in a clockwise direction and is slightly downward. The rotation of the central shaft 46 and the arrangement of the helical track 38 can be reversed so that the central shaft 46 is rotating in a clockwise direction and the helical track 38 is in a counterclockwise direction. The helical track 38 and the central shaft 46 can be oriented in the same direction, however, it is preferable to have the rotation of the central shaft 46 opposite to the arrangement of the helical track 38.

The interrelationship between the impeller diameter, the impeller angular velocity, the column diameter and the centrifugal forces necessary to throw the high density particles against the inner wall 40 may place practical upper limits on the column diameter. A practical upper limit for the angular velocity is believed to be about 5000 rpm. This in conjunction with the limitation on the diameter of the impeller and the generation of centrifugal forces sufficient to throw high density particles to the inner wall 40 may limit the column diameter to a diameter less than that typically available in larger flotation cells.

The CFC 10 is a vertically oriented column constructed out of any appropriate material for the manufacture of process equipment, such as, but not limited to, iron, mild steel, stainless steel, or fiberglass. The helical track 38 can be made from any suitable material, such as, but not limited to, iron, mild steel, stainless steel, rubber, plastic, or fiberglass. The cross-section of the helical track 38 can be square, rectangular, triangular or trapezoidal (as shown in FIG. 3). The helical track 38 is attached to the inside wall 40 by use of an appropriate adhesive, welding, soldering, or riveting with the aid of a support device.

Figure 5:
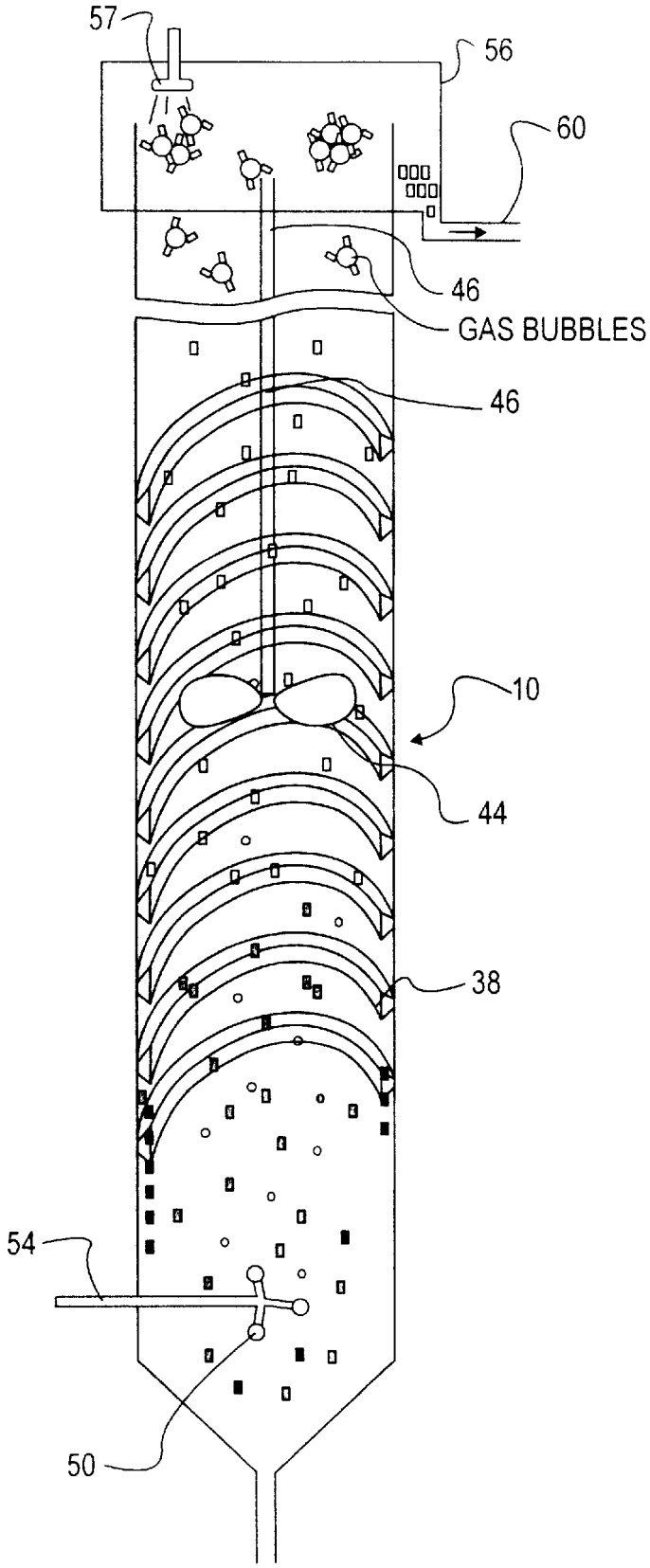
FIG. 5 is a split cross-sectional view illustrating the operation of the flotation column of this invention.

During flotation, as shown in FIG. 5, air bubbles are generated from the bottom 32 of the CFC 10 by air sparges 50. The hydrophobic particles (light particles) form a lightweight froth through the attachment of the hydrophobic particles to the rising air bubbles. The froth, due to its relatively light weight, is concentrated near the center of the CFC 10 and moves upward. Hydrophilic tailings (shaded particles), such as clay, stay with the liquid phase and proceeds down the CFC 10 to the bottom 32 along with the net movement of the liquid phase. The higher density particles (solid dark particles), due to their high specific gravity, swirl along the inner wall 40 of the CFC 10 and are caught in the helical track 38. The higher density particles are propelled down the helical track 38 by the movement of carrier fluid.

The hydrophobic particles combined with the froth move to the top 30 of the CFC 10 where they enter the defoamer 56 where the hydrophobic particles are rinsed with separation liquid fluid from sprayers 57 to free them from the foam. The sprayer 57 can be directed onto the froth in order to improve the separation efficiency by removing hydrophillic material from the froth and returning it to the CFC 10. The resulting clean hydrophobic particles or concentrates are conveyed to a storage chamber 58 through conduit 60. The hydrophilic tailings and the higher density particles proceed down the helical track 38 or through the CFC 10 to the bottom 32 of the CFC 10. The higher density particles and hydrophilic tailings proceed through the tailing conduit 62 through valve 64 and are transported by pump 66 to the tailings storage 70, by way of conduit 68 for later disposal.

EXAMPLES

Figure 1:
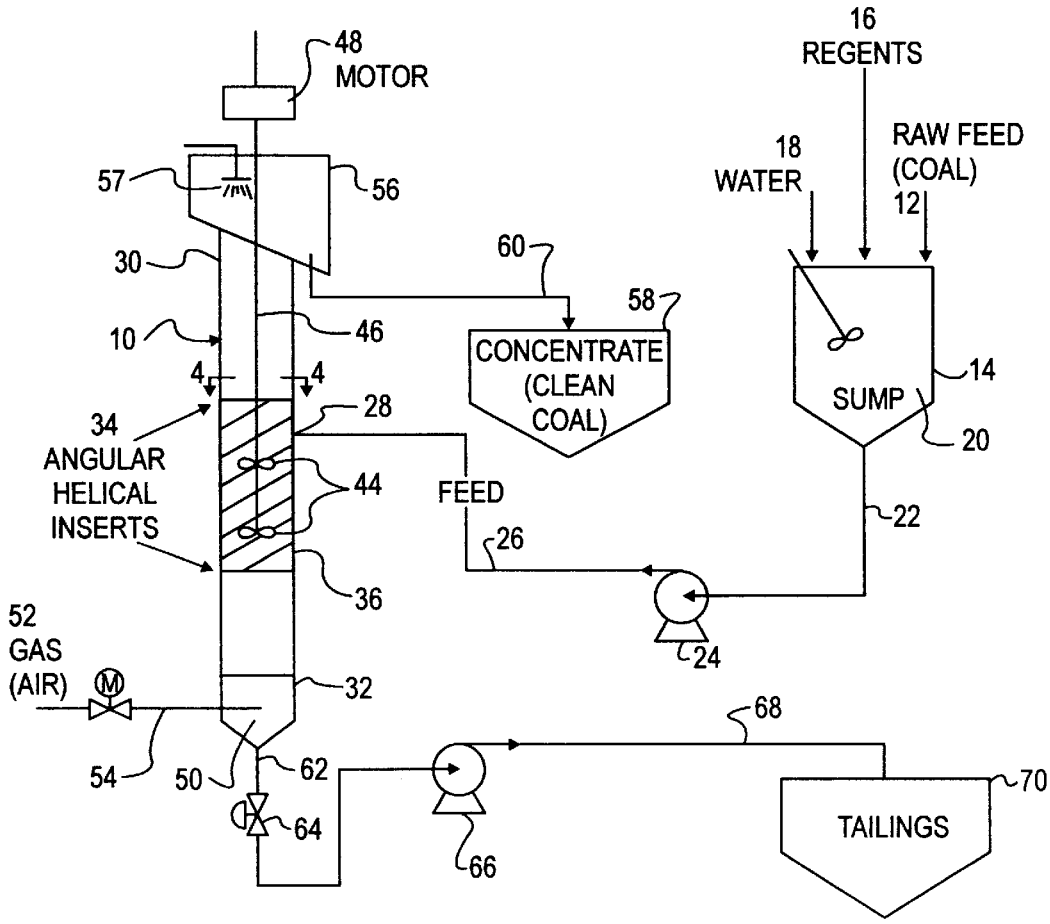
FIG. 1 is a flow sheet illustrating the flotation process using the flotation cell of this invention.

FIG. 1 shows the flow sheet of the flotation column circuit. The laboratory CFC used in these tests was 4 inches in diameter and 6 feet in height. A series of angular helical tracks was attached to the wall of a conventional column to produce the CFC of this invention. During these experiments a coal slurry was mixed with a series of impellers attached to a central shaft. In the operation of the CFC, air bubbles were generated with three air spargers located in the bottom chamber by air provided at 14 psig. A variable speed motor was used to turn the mixing impeller. The impeller speed was set at 1400 rpm for all the tests. The pitch of the impellers was set at 45 degrees. Experiments were carried out in a semi-continuous mode.

An Upper Freeport coal from Indiana County, Pennsylvania was used in these experiments. The sample was stage crushed and screened to collect the 100 M×325 M size fraction for experiments. The feed sample contained 26.4% ash and 2.9% sulfur (2.4% pyritic sulfur, 0.06% sulfate sulfur and 0.5% organic sulfur). The effect of frother concentration on the kinetics of coal recovery and the removal of pyrite was evaluated.

In each Test, 300 grams of coal were premixed in a 1500 ml beaker with an addition of 500 ml tap water. The coal and water mixture was conditioned for 5 minutes with an addition of variable amounts of methyl isobutyl carbinol (MIBC) frother. The column was filled with 9 L water, and then the preconditioned coal slurry was charged into the column for flotation. Clean coal froths were collected at various predetermined time periods until depletion of the froth.

During flotation, air bubbles were generated from the bottom of the column. The clean coal forms a lightweight froth through the attachment of coal particles to the rising air bubbles. This created a string of vortices near the shaft during the mixing. The slurry was moved in a circular motion by stirring in a counterclockwise direction and slightly upward, while the helical insert was arranged in a clockwise direction and was slightly downward. The froth, due to its relatively light weight, was concentrated near the center of the shaft and moves upward. The heavy pyrite, due to its high specific gravity, swirls along the wall of the column and was caught by the angular helix. The pyrite was washed downward along the helix by the movement of water.

RESULTS AND DISCUSSIONS

Figure 6:
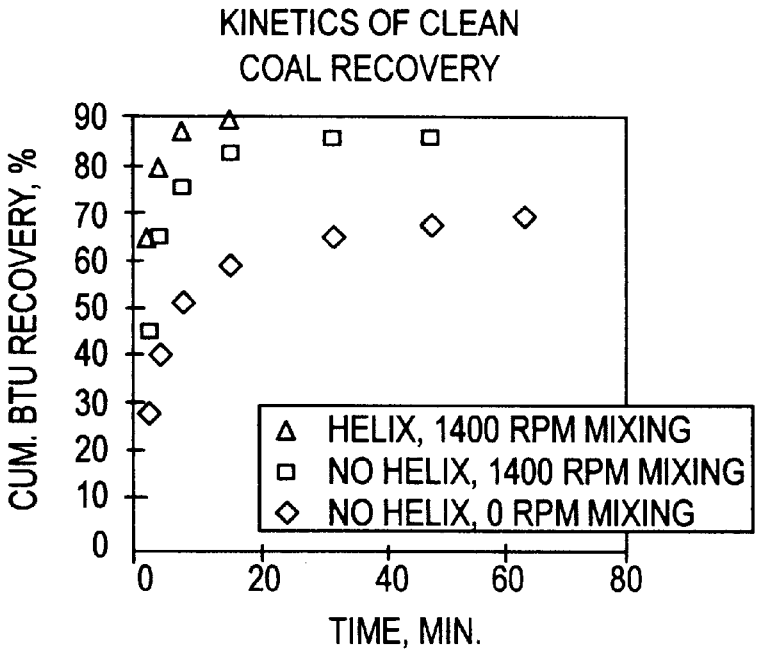
FIG. 6 is a graph of BTU recovery in percent verses time in Minutes
Figure 7:
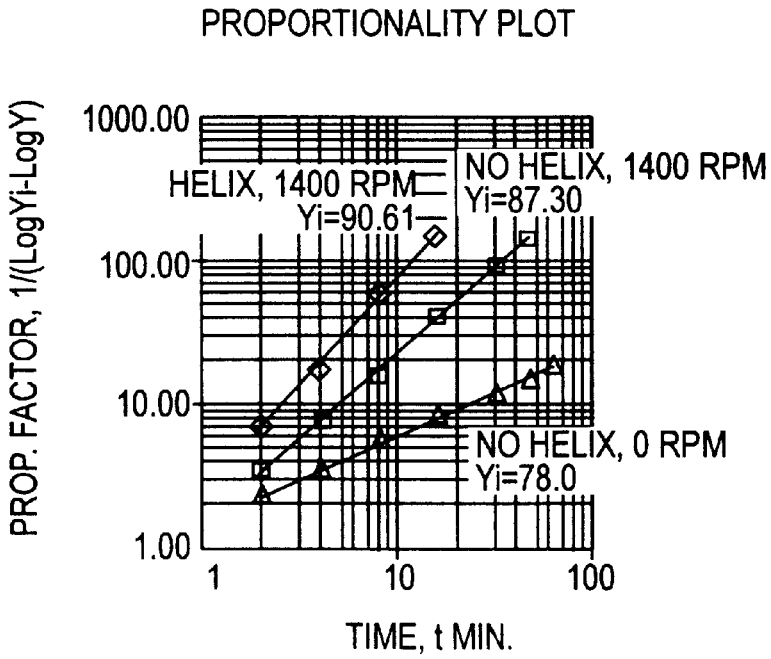
FIG. 7 is a graph of proportionality factor verses time.

A series of column flotation experiments were run to compare the kinetics of coal cleaning using three modes of operation: (1) without mixing and without helix attachment. (2) with 1400 rpm mixing but without helix attachment, and (3) with helix attachment and 1400 rpm mixing. FIG. 6 shows cumulative Btu recovery as a function of time for each of the above three flotation modes. The column with helix attachment and with mixing has superior recovery and superior kinetics. The asymptotes of the cumulative recovery curves are 90.6, 87.3, and 78.0 for modes 3, 2, and 1 respectively. FIG. 7 shows the kinetic plot for the three modes of operation. Mode 3 exhibits the highest rate as exemplified by the steepest slope.

Figure 8:
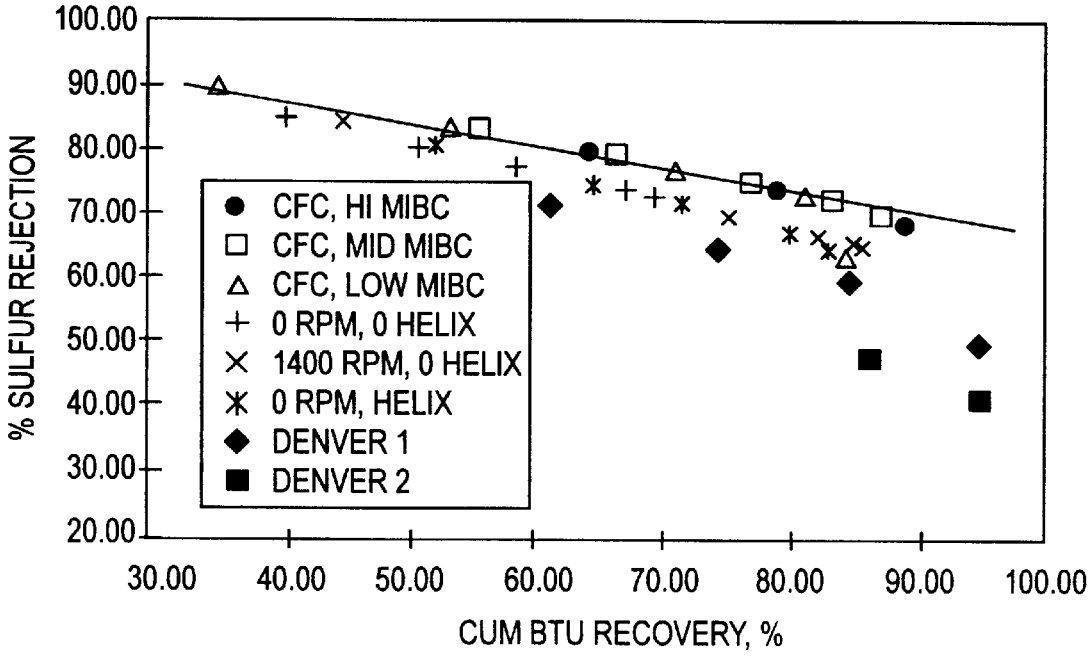
FIG. 8 is a graph of Sulfur rejection verses BTU recovery in percent.

Several tests were conducted to compare the pyritic sulfur rejection capabilities of the CFC column with those of more conventional flotation techniques (Denver Cell and an open column). The results are shown in FIG. 8. FIG. 8 indicates that the CFC achieved higher pyritic sulfur rejections than the other flotation systems, at all levels of frother concentration. The Denver cells had the poorest pyritic sulfur rejections, most likely because of the turbulent flotation conditions present in a Denver cell, which results in significant entrainment of unwanted mineral matter.

Thus, in accordance with the invention, there have been provided an improved froth flotation apparatus and process having an increased separation efficiency. There has also been provided an improved froth flotation device that augments the froth flotation process for the separation of fine particle minerals by the addition of density-based separation. There has also been provided an improved froth flotation process that removes higher density hydrophilic material by means in addition to froth flotation techniques. Additionally, there has been provided an improved means to separate coal from pyrite (and other heavy metals and minerals) by taking advantage of the large difference in their specific gravities, whereas the specific gravity of coal is 1.2, while the specific gravity of pyrite is 5.0.

With this description of the invention in detail, those skilled in the art will appreciate that modification may be made to the invention without departing form the spirit thereof. Therefore, it is not intended that the scope of the invention be limited to the specific embodiments that have been illustrated and described. Rather, it is intended that the scope to the invention is determined by the scope of the appended claims.

We claim:

1. A froth flotation column for the separation of at least two different materials comprising:

a cylindrical tubular column having a top end and a bottom end;

at least one helical track adjacent to the inner surface of said column and inclined toward the bottom of said column and located intermediate between said top end and said bottom end of said column, wherein said helical track has a first end and a second end and said helical track defines a separation zone between said top and said bottom end of said column said separation zone having a top edge and a bottom edge;

a rotating shaft located about the axis of said column, said shaft having a first end attached to a means for rotation and a second end terminating within the column;

at least one impeller attached to said rotating shaft adjacent to said rotating shaft second end and said impeller being located within the separation zone the region of said column;

an gas inlet means located adjacent to said bottom end of said column;

a feed inlet means for introduction of the material to be separated, said feed inlet means located intermediate between said top end and said bottom end of said column, said material comprising at least two components;

a first discharge means for removing at least one component from the column, said first discharge means located adjacent to said top end of said column; and a second discharge means for removing at least one component from said column, said second discharge means located adjacent to said bottom end of said column.

2. The froth flotation column of claim 1 wherein said helical track is inclined toward the bottom of said column at an angle from 10° to 60° from the horizontal.

3. The froth flotation column of claim 2 wherein said helical track is inclined from 25° to 45° from the horizontal.

4. The froth flotation column of claim 1 wherein said helical track inclined is attached to the inner surface of said column.

5. The froth flotation column of claim 1 wherein the upper surface of said helical track is inclined toward the inner surface of said column at an angle of from about 10° to about 60° from the horizontal.

6. The froth flotation column of claim 5 wherein the upper surface of said helical track inclined is inclined toward the inner surface of said column at an angle of from about 25° to about 45° from the horizontal.

7. The froth flotation column of claim 1 wherein the incline of said helical track is in the same direction as the rotation of said rotation means.

8. The froth flotation column of claim 1 wherein the incline of said helical track is in the opposite direction as the rotation of said rotation means.

9. The froth flotation column of claim 1 further comprising a concentrate holding tank attached to said first discharge means.

10. The froth flotation column of claim 1 further wherein the impeller rotates at an angular velocity of from 600 rpm to 3600 rpm.

11. The froth flotation column of claim 1 further comprising a tailings holding tank attached to said second discharge means.

12. A froth flotation column for the separation of at least two different materials comprising:

a cylindrical tubular column having an inner surface, a top end, and a bottom end;

at least one helical track adjacent to the inner surface of said column and inclined toward the bottom of said column and located intermediate between said top end and said bottom end of said column wherein said helical track has a first end and a second end and said helical track defines a separation zone between said top and said bottom end of said column said separation zone having a top edge and a bottom edge;

a feed inlet means for introduction of the material to be separated and a separation liquid, said feed inlet means located intermediate between said top end and said bottom end of said column, said material to be separated comprising at least two components, wherein one of the materials to be separated is of higher density than the other;

an agitation means for agitating the suspension liquid and said materials to be separated, wherein said agitation means generates a centrifugal force sufficient to direct the higher density material to said inner surface of said column where said higher density material is retained on said helical track and said material moves down said helical track to said bottom of said of said column;

a gas inlet means located adjacent to said bottom end of said column;

a first discharge means for removing at least one component from the column, said first discharge means located adjacent to said top end of said column; and a second discharge means for removing at least one component from said column, said second discharge means located adjacent to said bottom end of said column.

13. A froth flotation process for the separation of at least two different materials comprising:

mixing the materials to be separated with a suspension liquid and surface treatment chemicals to produce a separation mixture, wherein said material to be separated comprises at least two components, at least one of the materials to be separated being of higher density than the others;

transporting said separation mixture to a froth flotation column, said froth flotation column comprising a cylindrical tubular column having a top end and a bottom end, at least one helical track adjacent to the inner surface of said column and located intermediate between said top end and said bottom end of said column wherein said helical track has a first end and a second end and said helical track defines a separation zone between said top and said bottom end of said column said separation zone having a top edge and a bottom edge;

introducing said separation mixture into said froth flotation column;

introducing a gas stream into the separation column adjacent to said bottom end of said column;

agitating said separation mixture within said froth flotation column, wherein said agitation generates a centrifugal force sufficient to direct a sufficient portion of said higher density material to said inner surface of said column where said higher density material is retained on said helical track and said material moves down said helical track to said bottom of said of said column;

removing purified material and suspension liquid from said top end of said froth flotation column;

removing tailings from said bottom end of said froth flotation column.

14. The froth flotation process of claim 13 wherein agitation is provided by a rotating shaft having at least one impeller blade attached thereto and wherein at least one of said impellers is within the separation zone.

15. The froth flotation process of claim 13 further comprising the separating the purified material from the suspension liquid.

16. The froth flotation process of claim 13 further comprising the separating the tailings into solids and suspension liquid.

* * * * *